US007357218B2

(12) United States Patent
Sasaki

(10) Patent No.: US 7,357,218 B2
(45) Date of Patent: Apr. 15, 2008

(54) FRAME FOR SPEAKER DEVICE AND SPEAKER DEVICE

(75) Inventor: Hiromitsu Sasaki, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 262 days.

(21) Appl. No.: 11/356,020

(22) Filed: Feb. 17, 2006

(65) Prior Publication Data

US 2006/0237258 A1 Oct. 26, 2006

(30) Foreign Application Priority Data

Feb. 17, 2005 (JP) ..... 2005-040036

(51) Int. Cl.

| | |
|---|---|
| ***H04R 1/02*** | (2006.01) |
| ***H04R 9/02*** | (2006.01) |
| ***H04R 9/04*** | (2006.01) |
| *H04R 1/00* | (2006.01) |

(52) U.S. Cl. ..... 181/171; 381/433

(58) Field of Classification Search ..... 181/171, 181/148; 381/395, 433

See application file for complete search history.

(56) References Cited

U.S. PATENT DOCUMENTS

| | | | | |
|---|---|---|---|---|
| 2,611,830 | A * | 9/1952 | Heineman | 381/189 |
| 5,566,242 | A * | 10/1996 | Hall | 381/423 |
| 6,731,773 | B1 * | 5/2004 | Bergbower et al. | 381/397 |
| 7,164,777 | B1 * | 1/2007 | Stompler | 381/433 |
| 2006/0171557 | A1 * | 8/2006 | Chan | 381/433 |

FOREIGN PATENT DOCUMENTS

| | | | |
|---|---|---|---|
| JP | 05347795 | A * | 12/1993 |
| JP | 6-245295 | | 9/1994 |
| JP | 07038992 | A * | 2/1995 |
| JP | 7-95687 | | 4/1995 |
| JP | 08070495 | A * | 3/1996 |
| JP | 2002-142290 | | 5/2002 |
| JP | 2004312338 | A * | 11/2004 |

* cited by examiner

*Primary Examiner*—Edgardo San Martin
(74) *Attorney, Agent, or Firm*—Young & Thompson

(57) ABSTRACT

A speaker device includes a magnetic circuit system and a vibration system including a frame. The frame has a magnetic circuit housing unit housing the magnetic circuit, an outer peripheral portion arranged on an outer side thereof and having an annular shape, and plural arm parts connecting the magnetic circuit housing unit and the outer peripheral portion. A damper mounting part on which an outer peripheral portion of a damper is mounted is formed at the outer peripheral portion of the magnetic circuit housing unit. A rib upwardly standing is provided at the outer peripheral portion of an upper surface of the damper mounting part. The height of the vicinity of the connecting part between the rib and the arm part is set larger than the height of the rib corresponding to an area other than the vicinity, and thus the height of the rib is partly different. By reflecting this, the part of the rib corresponding to the connecting part between the rib and the arm part is formed to have a mountain shape when observed from the side. The height of the rib corresponding to the connecting part between the rib and the arm part is set to the height capable of withstanding the stress operating on the connecting part between the rib and the arm part at the time of the driving of the speaker device, and the height capable of regulating the position of the damper when the damper is mounted on the damper mounting part.

5 Claims, 8 Drawing Sheets

FRAME FOR SPEAKER DEVICE AND SPEAKER DEVICE

TECHNICAL FIELD

The present invention relates to a configuration of a frame for a speaker device.

BACKGROUND ART

Conventionally, there is known a speaker device including a vibrating system having a frame and a diaphragm, and a magnetic circuit system having a yoke, a magnet and a plate.

In the speaker device, the frame is formed into a bowl shape, for example. The frame having such a shape includes a magnetic circuit housing unit holding the magnetic circuit, an outer peripheral portion arranged on an outer side of the magnetic circuit housing unit and having an edge mounting part on which an outer peripheral portion of an edge is mounted, and plural arm parts connecting the magnetic circuit housing unit and the outer peripheral portion.

Examples of the frame having the configuration of this kind are disclosed in Japanese Patent Application Laid-opens under No. 6-245295, No. 2002-142290 and No. 7-95687 (hereinafter referred to as "Reference-1", "Reference-2" and "Reference-3", respectively). On the speaker frame according to Reference-1, a reinforcement rib is provided on each frame arm in order to improve the strength and decrease the weight. On the speaker frame according to Reference-2, a connecting part between a leg part (arm part) and the magnetic circuit mounting part, i.e., a corner part, is chamfered in order to reinforce the connection between the leg part (arm part) and the magnetic circuit mounting part and improve the strength of the speaker frame. Further, on the speaker frame according to Reference-3, the strength of the leg part connecting an edge supporting part and a magnetic circuit mounting part is inconstantly set in order to suppress divided vibration of the speaker frame.

In the above speaker device, at the time of driving thereof, the stress concentrates on the connecting part between the outer peripheral wall of the magnetic circuit housing unit and each of the arm parts on the frame. However, though the stress is different between the connecting part and a part other than the connecting part, the two parts are formed into the same shape.

DISCLOSURE OF THE INVENTION

The present invention has been achieved in order to solve the above problem. It is an object of this invention to provide a frame for a speaker device and a speaker device including the frame, capable of reducing a material forming a rib and lightening a frame by partly changing a height of the rib without decreasing the strength of a connecting part between an arm part and the rib.

According to one aspect of the present invention, there is provided a frame for a speaker device including: a damper mounting part which has an annular shape and on which an outer peripheral portion of a damper is mounted; an edge mounting part which is arranged on an outer side of the damper mounting part and on which an outer peripheral portion of an edge is mounted; an arm part which connects the damper mounting part and the edge mounting part; and a rib which is provided to stand from an outer peripheral portion of the damper mounting part, wherein a height of the rib corresponding to a connecting part between the arm part and the rib is set larger than a height of the rib corresponding to a part other than the connecting part.

The above frame for the speaker device includes the damper mounting part which has the annular shape and on which the outer peripheral portion of the damper is mounted, the edge mounting part which is arranged on the outer side of the damper mounting part and on which the outer peripheral portion of the edge is mounted, the arm part which connects the damper mounting part and the edge mounting part, and the rib which is provided to stand from the outer peripheral portion of the damper mounting part.

In the speaker device including the frame for the speaker device, at the time of the driving thereof, the stress concentrates on the connecting part between the arm part and the outer peripheral wall of the damper mounting part including the rib. In this point, on the frame for the speaker device, the height of the rib corresponding to the connecting part between the arm part and the rib is set larger than the height of the rib corresponding to the part other than the connecting part. Therefore, the strength of the connecting part can be improved.

In addition, on the frame for the speaker device, at the time of the driving of the speaker device, so large stress does not operate on the part of the rib (hereinafter simply referred to as "rib corresponding to a non-connecting part") corresponding to the part other than the connecting part between the arm part and the outer peripheral wall of the damper mounting part including the rib. Thus, the height of the rib corresponding to the disconnecting part may be smaller than the height of the rib corresponding to the connecting part. In this point, on the frame for the speaker device, the height of the rib corresponding to the part other than the connecting part between the arm part and the rib is set smaller than the height of the connecting part between the arm part and the rib. Therefore, the material forming the rib can be reduced, as compared with the frame on which the height of the rib corresponding to the connecting part between the arm part and the rib and the height of the rib corresponding to the non-connecting part are identically set. Accordingly, the frame for the speaker device can be lightened.

In a preferred example, the height of the rib corresponding to the connecting part may be a height from an upper surface of the damper mounting part to an upper surface of the rib corresponding to the connecting part, and the height of the rib corresponding to the part other than the connecting part may be a height from the upper surface of the damper mounting part to the upper surface of the rib corresponding to the part other than the connecting part. In addition, the height of the rib corresponding to the connecting part may be formed at least equal to or larger than a thickness of the damper. Additionally, the rib corresponding to the connecting part may be formed into a mountain shape, a step shape or a projection shape when observed from a side thereof.

According to another aspect of the present invention, there is provided a speaker device including a frame including: a damper mounting part which has an annular shape and on which an outer peripheral portion of a damper is mounted; an edge mounting part which is arranged on an outer side of the damper mounting part and on which an outer peripheral portion of an edge is mounted; an arm part which connects the damper mounting part and the edge mounting part; and a rib which is provided to stand from an outer peripheral portion of the damper mounting part, wherein a height of the rib corresponding to the connecting part between the arm part and the rib is set larger than a height of the rib corresponding to a part other than the connecting part.

BEST MODE FOR CARRYING OUT THE INVENTION

The preferred embodiments of the present invention will now be described below with reference to the attached drawings. In this embodiment, on the frame for the speaker device, it is realized to reduce the material forming the rib and lighten the frame by partly changing the height of the rib without decreasing the strength of the connecting part between the arm part and the rib.

Configuration of Speaker Device

First, a description will be given of a configuration of a speaker device 100 according to an embodiment of the present invention with reference to FIG. 1 to FIG. 5.

Figure 1:
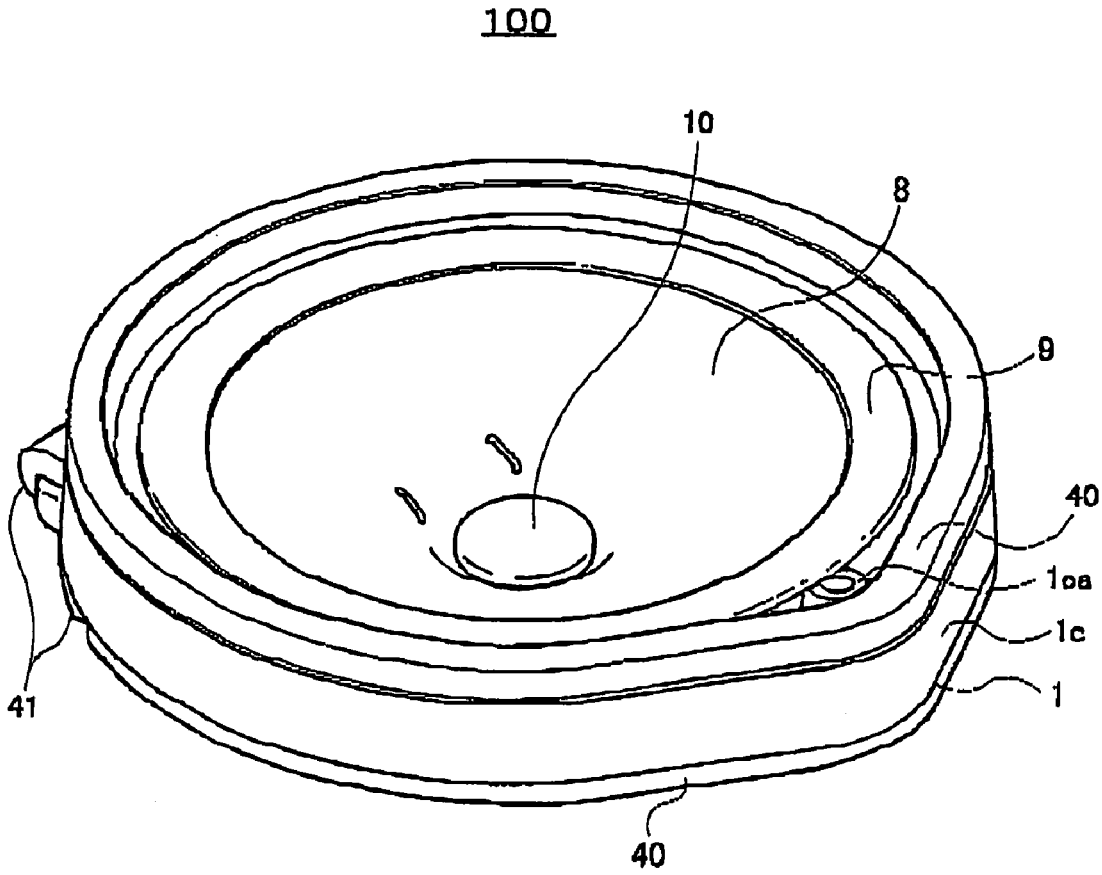
FIG. 1 shows a perspective view of a speaker device according to an embodiment of the present invention when observed from a sound output side.
Figure 2:
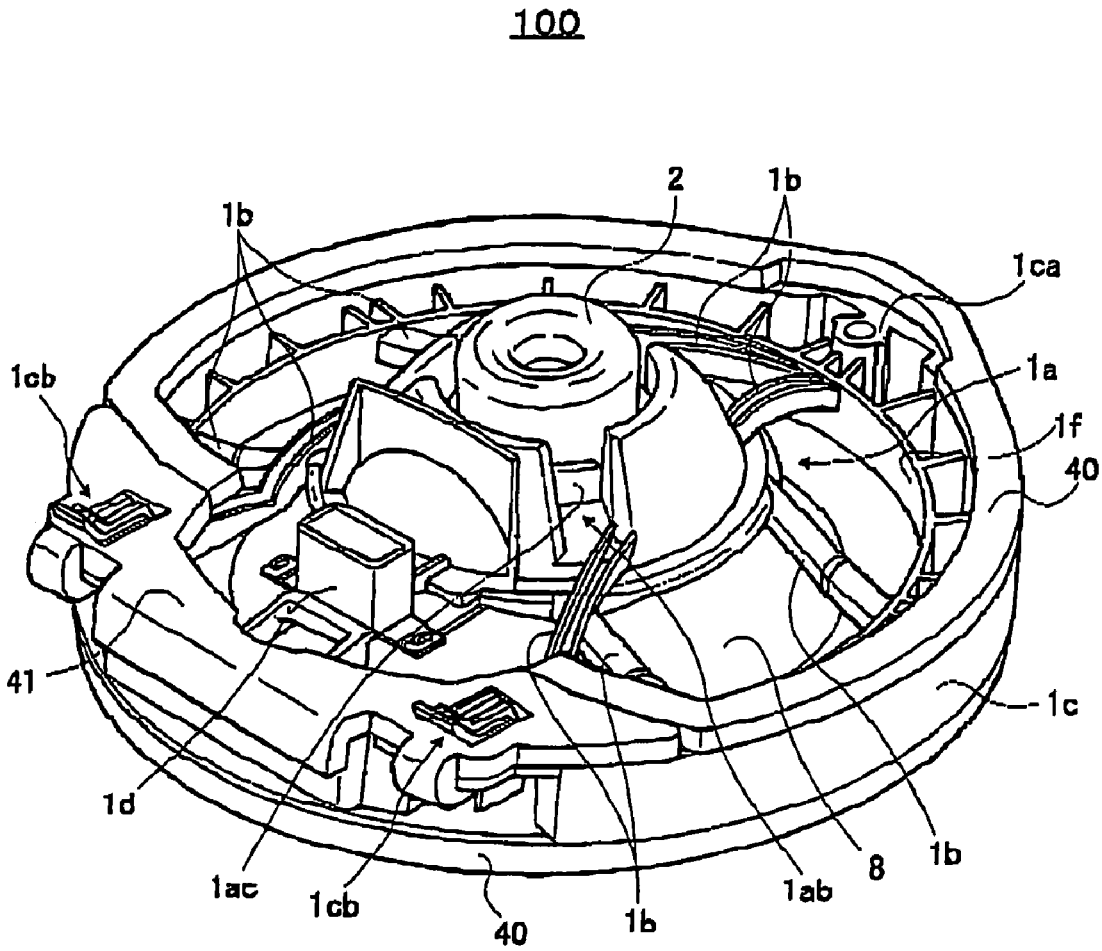
FIG. 2 shows a perspective view of the speaker device according to the embodiment when observed from a direction opposite to the sound output side.
Figure 3:
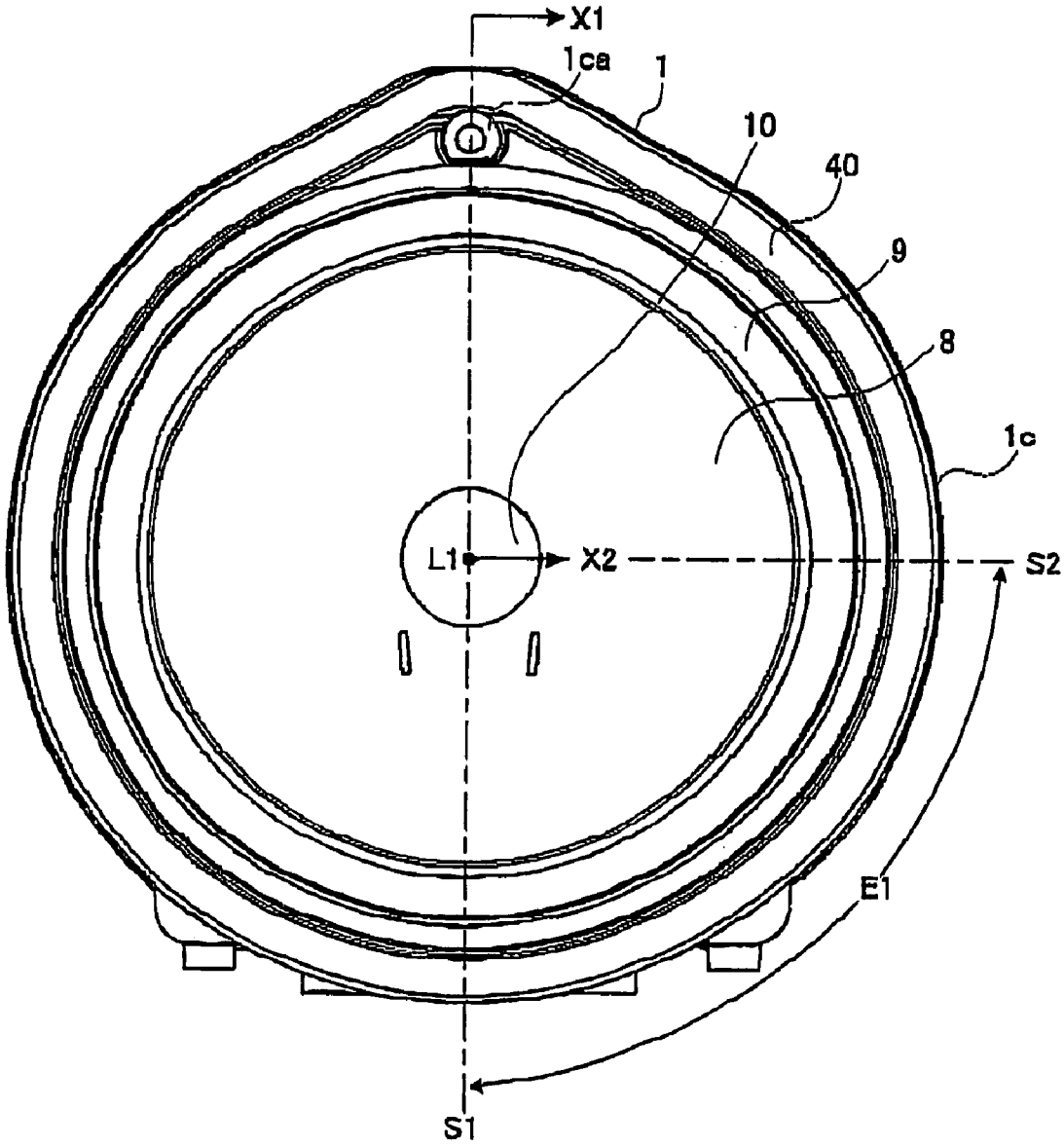
FIG. 3 shows a front view of the speaker device according to the embodiment.
Figure 4:
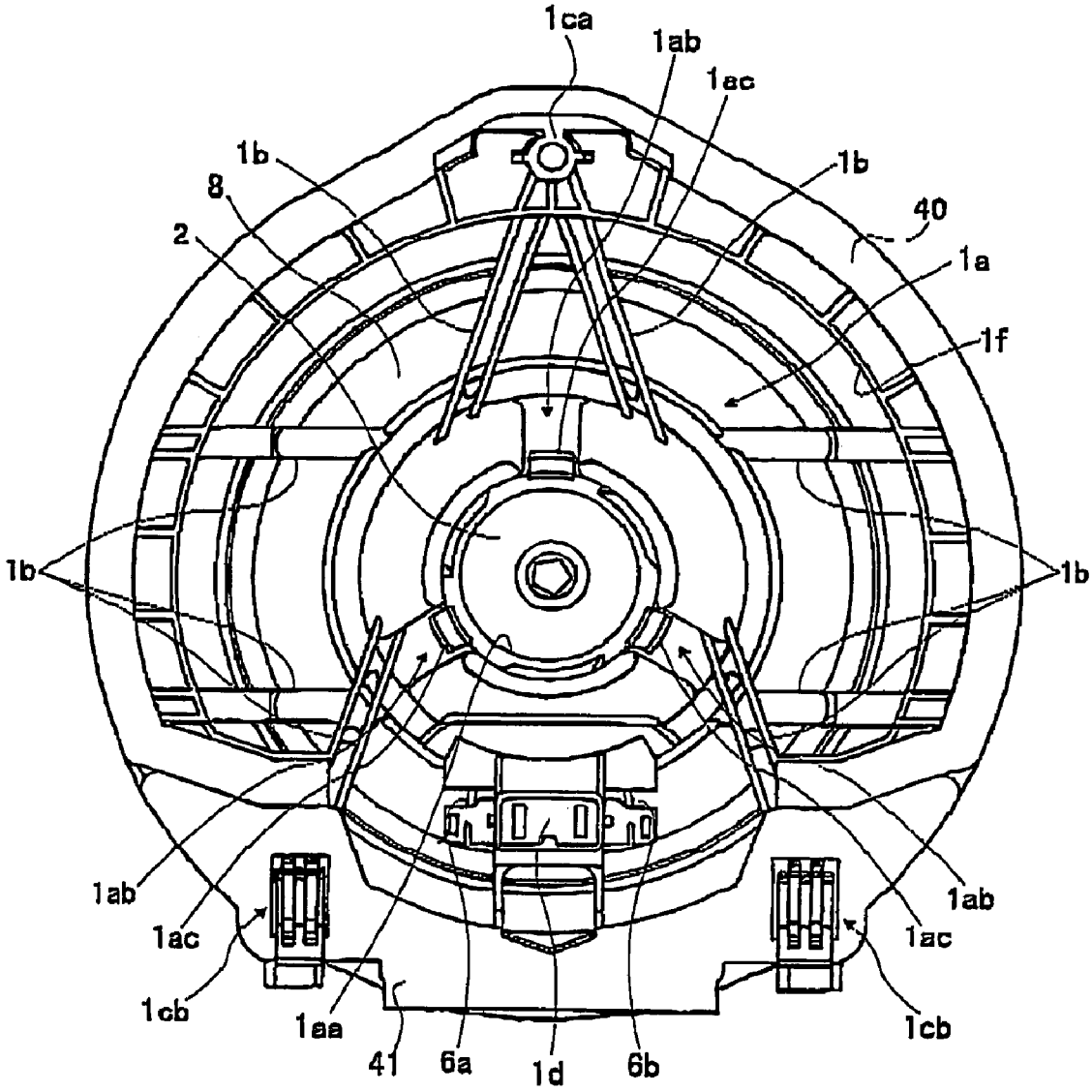
FIG. 4 shows a rear view of the speaker device according to the embodiment.
Figure 5:
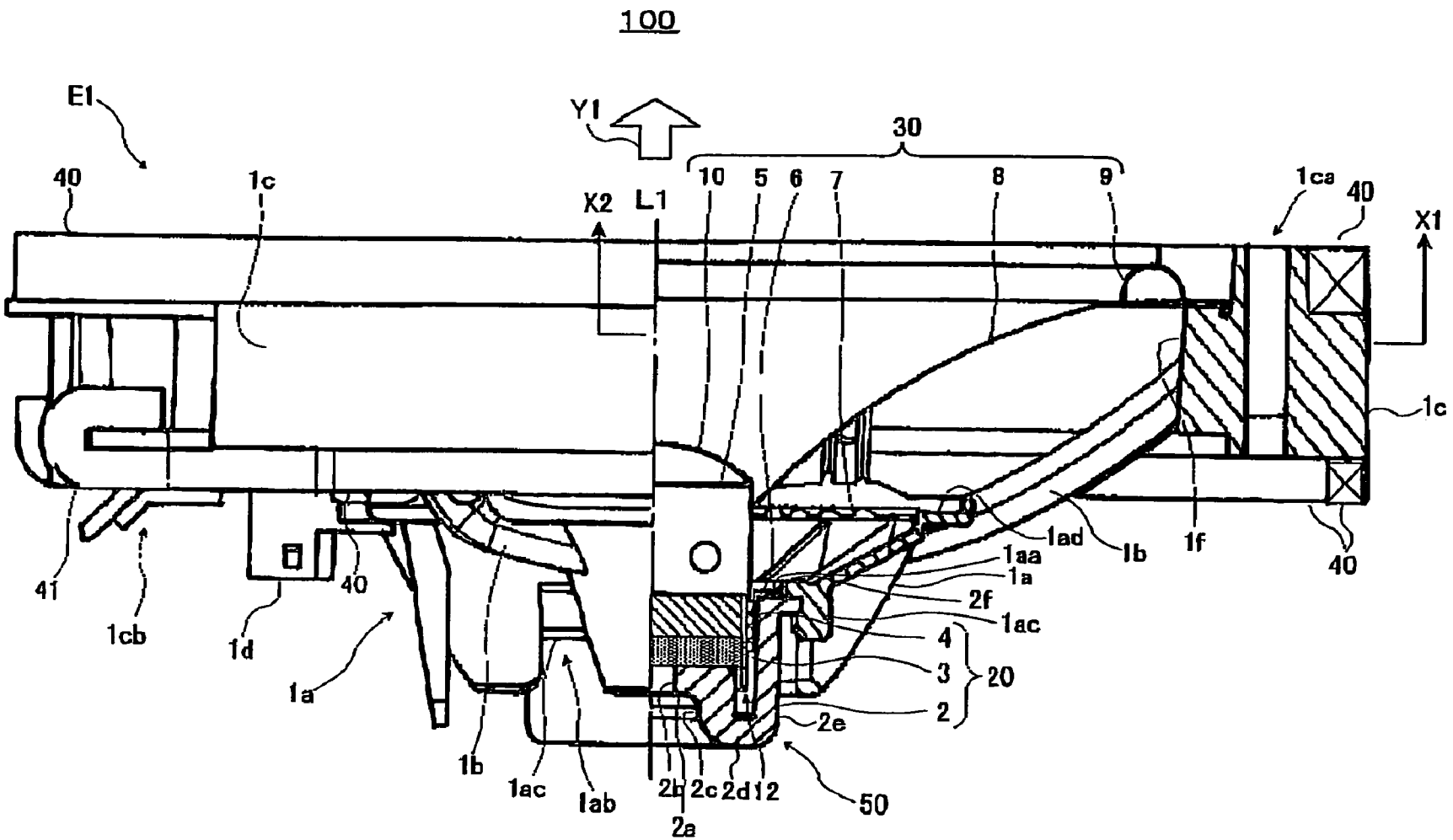
FIG. 5 shows an one-side cross-sectional view and an one-side side view of the speaker device according to the embodiment.

FIG. 1 shows a perspective view of the speaker device 100 according to an embodiment of the present invention in a case that it is observed from its sound output side. FIG. 2 shows a perspective view of the speaker device 100 in a case that it is observed from a side opposite to the sound output side, i.e., from a rear side. FIG. 3 shows a front view of the speaker device 100 in the case that it is observed from the sound output side. FIG. 4 shows a rear view of the speaker device 100 in the case that it is observed from the side opposite to the sound output side, i.e., from the rear side. FIG. 5 shows a cross-sectional view of the speaker device 100 on the right side of the drawing with respect to a central axis L1 of the speaker device 100 (or a frame 1) and a side view of the speaker device 100 on the left side of the drawing with respect to the central axis L1, respectively. In addition, the cross-sectional view shown on the right side of FIG. 5 is a cross-sectional view taken along the cutting-plane line X1-X2 of the speaker device 100 shown in FIG. 3. The side view shown on the left side of FIG. 5 corresponds to a side surface portion E1 of the speaker device 100 between a plane surface S1 passing through the central axis L1 of the speaker device 100 and a plane surface S2 passing through the central axis L1 and perpendicular to the plane surface S1 in FIG. 3.

The speaker device 100 according to this embodiment can be preferably used as an on-vehicle speaker device. The speaker device 100 is configured by mounting a speaker unit 50 onto the frame 1.

The speaker unit 50 includes a magnetic circuit system 20 having a yoke 2, a magnet 3 and a plate 4, and a vibrating system 30 having a voice coil bobbin 5, a voice coil 6, a damper 7, a diaphragm 8, an edge 9 and a cap 10.

First, each component of the magnetic circuit system 20 will be explained.

The magnetic circuit system 20 is configured as an internal magnet type magnetic circuit.

The yoke 2 is formed into a substantial pot shape. The yoke 2 has a first flat part 2*a* for supporting the disc-shape magnet 3, an opening 2*b* formed at a substantial center of the first flat part 2*a*, a first cylindrical part 2*c* connected to an outer peripheral portion of the first flat part 2*a*, a second flat part 2*d* connected to a lower end portion of the first cylindrical part 2*c*, a second cylindrical part 2*e* connected to an outer peripheral portion of the second flat part 2*d* and a flange part 2*f* connected to an upper end portion of the second cylindrical part 2*e* and outwardly extending from the upper end portion. Each of the components is integrally formed.

An upper surface of the first flat part 2*a* has flatness. The opening 2*b* has a function of radiating a heat generated in the magnetic circuit system 20 to the outside. The first cylindrical part 2*c* is formed into a cylindrical shape. In FIG. 5, by forming the first cylindrical part 2*c* to have a predetermined length in the direction of an arrow Y1, a relative positional relation of components of the vibrating system 30 with respect to the magnet 3 and the plate 4 can be adjusted. A lower surface of the second flat part 2*d* has flatness. The second flat part 2*d* has a function of forming a constant gap between the first cylindrical part 2*c* and the second cylindrical part 2*e*. The second cylindrical part 2*e* is formed into a cylindrical shape and is provided on the outer side of the first cylindrical part 2*c*. The second cylindrical part 2*e* has a function of forming a magnetic gap 12 between an inner peripheral wall of the second cylindrical part 2*e* and each of the outer peripheral walls of the magnet 3 and the plate 4. The flange part 2*f* is fixed to a magnetic circuit housing unit 1*a* being a component of the frame 1. By mounting the flange part 2*f* onto the magnetic circuit housing unit 1*a*, the magnetic circuit system 20 can be housed into the magnetic circuit housing unit 1*a*.

The magnet 3 is formed into a disc shape and is mounted onto the first flat part 2*a* of the yoke 2. On the magnet 3, the disc-shape plate 4 having the substantially same diameter as the magnet 3 is mounted.

In the magnetic circuit system 20 having such a configuration, the magnet 3 and the plate 4 configure the magnetic circuit, and magnetic flux of the magnet 3 is concentrated on the magnetic gap 12 formed between the outer peripheral wall of the plate 4 and the inner peripheral wall of the second cylindrical part 2*e*.

Next, each component of the vibrating system 30 will be explained.

The voice coil bobbin 5 is formed into a substantially cylindrical shape. The voice coil 6 which will be explained later is wound around the vicinity of the lower end portion of the outer peripheral wall of the voice coil bobbin 5. The vicinity of the lower end portion of the inner peripheral wall of the voice coil bobbin 5 is opposite to each of the outer peripheral walls of the magnet 3 and the plate 4 with constant spaces therebetween. Meanwhile, the vicinity of the lower end portion of the outer peripheral wall of the voice coil bobbin 5 is opposite to the vicinity of the upper end portion of the inner peripheral wall of the second cylindrical part 2*e* being the component of the yoke 2 with a constant space therebetween. A gap (magnetic gap 12) is formed between the inner peripheral wall of the second cylindrical part 2*e* and the outer peripheral wall of the plate 4.

The voice coil 6 has one wiring, which includes a plus lead wire 6*a* and a minus lead wire 6*b* as shown in FIG. 4. The plus lead wire 6*a* is an input wiring for an L (or R)-channel signal, and the minus lead wire 6*b* is an input wiring for a ground (GND: ground) signal. The lead wires 6*a* and 6*b* are electrically connected to a terminal 1*d* provided on the frame 1. In addition, the terminal 1*d* is electrically connected to a wiring on an output side of an amplifier (not shown). Thereby, the signal and the power of one channel are inputted to the voice coil 6 from the amplifier side via the terminal 1*d* and the lead wires 6*a* and 6*b*.

The damper 7 is formed into an annular shape and has an elastic part on which corrugations are concentrically formed. An inner peripheral edge portion of the damper 7 is mounted onto the vicinity of the upper end portion of the outer peripheral wall of the voice coil bobbin 5. Meanwhile, an outer peripheral edge portion of the damper 7 is mounted onto the outer peripheral portion of the magnetic circuit housing unit 1*a*.

Various kinds of materials such as paper, high polymer and metal can be applied to the diaphragm 8 in accordance with the various use purposes. The diaphragm 8 is formed into a cone shape. An inner peripheral edge portion of the diaphragm 8 is mounted onto the vicinity of the upper end portion of the outer peripheral wall of the voice coil bobbin 5 and onto the upper side of the damper 7. Meanwhile, the outer peripheral edge portion of the diaphragm 8 is mounted onto the inner peripheral edge portion of the annular edge 9. The outer peripheral edge portion of the edge 9 is mounted onto an outer peripheral portion 1*c* of the frame 1. In this example, the diaphragm 8 and the edge 9 are independently formed. However, this invention is not limited to this. Namely, the diaphragm 8 and the edge 9 may be integrally formed.

The cap 10 is formed into a substantial dome shape and is mounted onto the outer peripheral wall of the voice coil bobbin 5 in a manner to cover the upper surface of the voice coil bobbin 5. Thereby, it can be prevented that dust and foreign matter enter the inner side of the speaker unit 50.

The frame 1 is formed with various kinds of materials such as a metal and a resin. For the purpose of lightening the speaker device 100, the frame 1 is preferably formed with a resin material. The frame 1 mainly includes the magnetic circuit housing unit 1*a*, the outer peripheral portion 1*c* arranged on the outer side and the upper side of the magnetic circuit housing unit 1*a*, plural arm parts 1*b* connecting the magnetic circuit housing unit 1*a* and the outer peripheral portion 1*c*, and the terminal 1*d* provided in the vicinity of the outer peripheral portion of the magnetic circuit housing unit 1*a*. Each of the components is integrally formed. In addition, on the frame 1, an opening 1*f* is formed between the magnetic circuit housing unit 1*a* and the outer peripheral portion 1*c*.

The magnetic circuit housing unit 1*a* is formed into a substantial bowl shape and has an opening 1*aa*, cut-out parts 1*ab* and plural fixing parts 1*ac*. The diameter of the opening 1*aa* is substantially same as an outside diameter of the second cylindrical part 2*e* of the yoke 2. When the direction of the central axis L1 of the speaker device 100 is prescribed as the vertical direction in FIG. 5, the opening 1*aa* is formed at a position corresponding to the substantial center of the vertical direction of the magnetic circuit housing unit 1*a*. Each of the cut-out parts 1*ab* is formed by removing a part of the outer peripheral wall of the magnetic circuit housing unit 1*a*, and it is formed in the vicinity of the outer peripheral wall thereof with proper spaces therebetween. Each of the fixing parts 1*ac* is formed in the vicinity of the opening 1*aa* and at a position corresponding to the cut-out part 1*ab*. In addition, each of the fixing parts 1*ac* is formed along the circumferential direction of the opening 1*aa* with proper spaces therebetween.

One end of each arm part 1*b* is mounted onto the outer peripheral wall of the magnetic circuit housing unit 1*a*, and the other end thereof is attached to the inner peripheral wall of the outer peripheral portion 1*c*.

The outer peripheral portion 1*c* is formed into a substantially annular shape, and is provided on the outer side of the magnetic circuit housing unit 1*a* and the plural arm parts 1*b*. The outer peripheral portion of the edge 9 and cushion members 40 and 41 are mounted onto the outer peripheral portion 1*c*. The outer peripheral portion 1*c* has mounting parts 1*ca* and 1*cb* for mounting the speaker device 100 onto the mounting base such as an inner panel of the vehicle door, for example.

The mounting part 1*ca* is an inserting hole into which a bolt is inserted, and is provided at the position opposite to the terminal 1*d* at the outer peripheral portion 1*c*. The mounting parts 1*cb* are formed into a claw shape, and they are provided at the position opposite to the mounting part 1*ca* on the lower surface side of the outer peripheral portion 1*c* and in the vicinity of the terminal 1*d*. In addition, the one mounting part 1*cb* and the other mounting part 1*cb* are provided on the lower surface side of the outer peripheral portion 1*c* with a constant space therebetween.

To the upper surface of the outer peripheral portion 1*c* and a part of the lower surface of the outer peripheral portion 1*c*, a cushion member 40 having a cushion property and formed into a stick shape are attached in a state deformed into a substantial circle shape. As the cushion member 40, a member having an elastic property such as sponge and urethane is preferable, for example. In addition, to the other part of the lower surface of the outer peripheral portion 1*c* on the side of the plural mounting parts 1*cb*, a cushion member 41 formed with the same member as the cushion member 40 and formed into a shape shown in FIG. 5 is attached. Onto one surface of each of the cushion members 40 and 41, a seal having an adhesive property is printed or an adhesive is applied.

The above-mentioned speaker unit 50 is mounted onto the frame 1 in a manner which will be explained below. In FIG. 5, the voice coil bobbin 5 and the cap 10 being the components of the vibrating system 30 are inserted into the opening 1*aa* of the magnetic circuit housing unit 1*a* from the direction of the arrow Y1, and the upper end portion of the voice coil bobbin 5 and the cap 10 are disposed at the upper portion of the surface on the sound output side of the diaphragm 8. In this state, the flange part 2*f* being the component of the yoke 2 is fixed to the plural fixing parts 1*ac* provided in the magnetic circuit housing unit 1*a*. In this manner, the speaker unit 50 is mounted onto an appropriate position of the frame 1, and the speaker device 100 is configured.

In the speaker device 100 having the above-mentioned configuration, the signal and power outputted from the amplifier are inputted to the voice coil 6 via the terminal 1*d*, and the lead wires 6*a* and 6*b* of the voice coil 6. Thereby, a driving force occurs to the voice coil 6 in the magnetic gap 12, which vibrates the diaphragm 8 in the direction of the central axis L1 of the speaker device 100 in FIG. 5. In this manner, the speaker device 100 emits an acoustic wave in the direction of the arrow Y1 shown in FIG. 5.

Configuration of Frame

Figure 6:
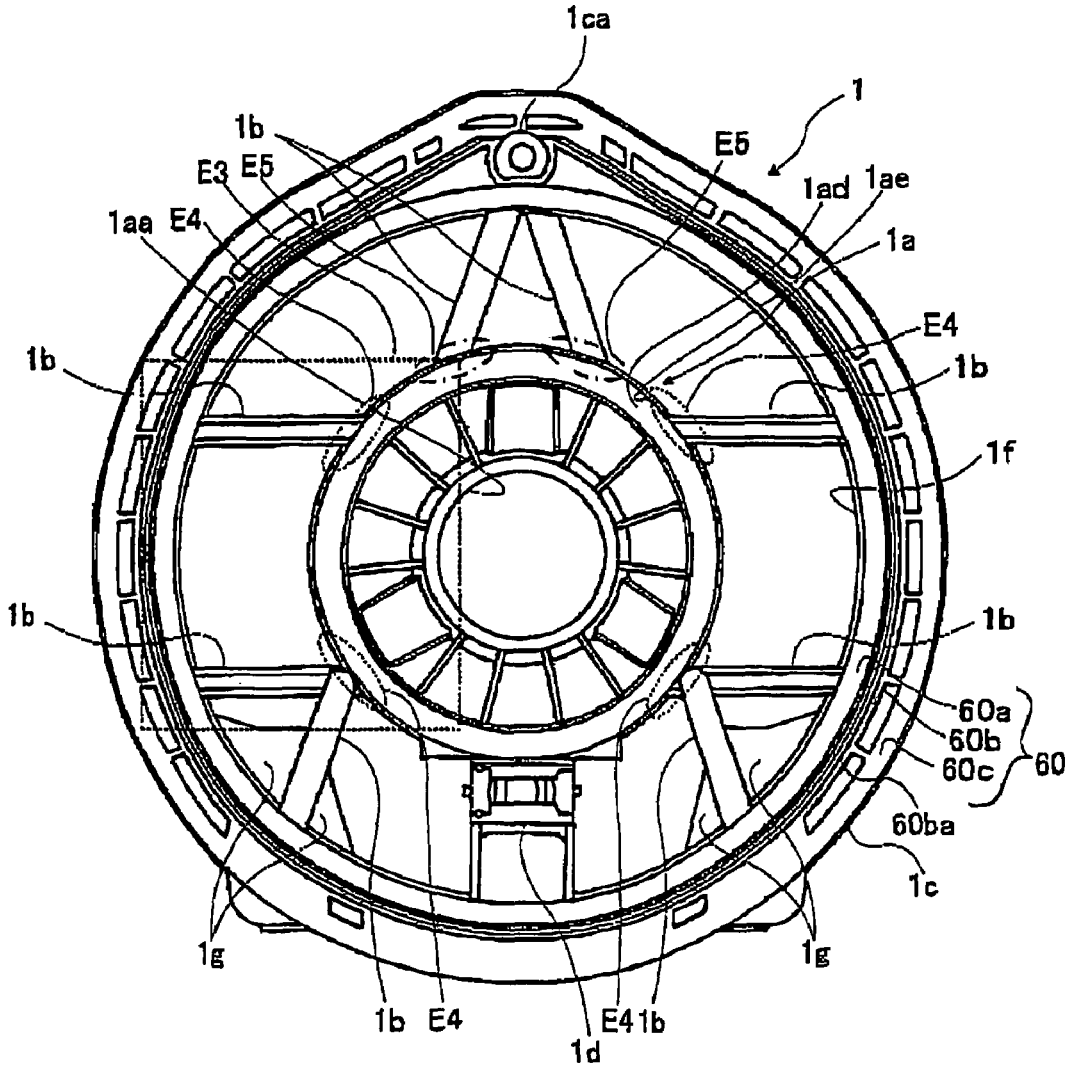
FIG. 6 shows a front view of a frame according to the embodiment of the present invention.

Next, a description will be given of the configuration of the frame 1 characterized by the present invention, with reference to FIG. 6. FIG. 6 shows a front view of the frame 1.

Since the basic configuration of the frame 1 is described above, the explanation is omitted. Therefore, a description will be mainly given of the components related to the present invention below.

The outer peripheral portion 1*c* of the frame 1 has an upper surface 60 formed into an annular shape. The upper surface 60 has plural flat surfaces, i.e., a flat surface 60*a*, a flat surface 60*b* and a flat surface 60*c*. As shown in FIG. 6, the flat surface 60*a* is formed on the side of the inner peripheral wall of the outer peripheral portion 1*c*. The outer peripheral edge portion of the edge 9 is mounted on the flat surface 60*a* which functions to support the edge 9. Hereinafter, the flat surface 60*a* is also referred to as "edge mounting part" as the need arises. The flat surface 60*b* is formed on the outer side of the flat surface 60*a*. An annular projecting part 60*ba* projecting on the upper side of the drawing and formed into an annular shape is formed on a part of the flat surface 60*b*. The annular projecting part 60*ba* functions to position the cushion member 40 at an appropriate position on the upper surface 60 of the outer peripheral portion 1*c*. In a preferred example, the height of the annular projecting part 60*ba* may be same as the thickness of the cushion member 40. The flat surface 60*c* is formed with a constant space from the flat surface 60*b* and on the outer side of the flat surface 60*b*. Namely, the flat surface 60*c* is formed on the side of the outer peripheral wall of the outer peripheral portion 1*c*. The flat surfaces 60*a*, 60*b* and 60*c* have flatness and become flush with each other. The cushion member 40 is attached onto the flat surfaces 60*b* and 60*c* of the plural flat surfaces.

The magnetic circuit housing unit 1*a* further includes a damper mounting part 1*ad* and a rib 1*ae* other than the above-mentioned components. The damper mounting part 1*ad* is formed into an annular shape. The upper surface of the damper mounting part 1*ad* has flatness, and the outer peripheral edge portion of the damper 7 is mounted on the upper surface. The one-side cross-sectional view of FIG. 5 shows such a state that the outer peripheral edge portion of the damper 7 is mounted on the upper surface of the damper mounting part 1*ad*. The rib 1*ae* stands from the outer peripheral edge portion of the upper surface of the damper mounting part 1*ad*. The rib 1*ae* mainly has a function to position the damper 7 at an appropriate position on the damper mounting part 1*ad* and a function to improve connecting strength between each of the arm parts 1*b* and the damper mounting part 1*ad*.

The plural arm parts 1*b* connect the outer peripheral wall of the magnetic circuit housing unit 1*a* (including the outer peripheral wall of the rib 1*ae*) and the inner peripheral wall of the outer peripheral portion 1*c*. Therefore, the plural arm parts 1*b* indirectly connect the edge mounting part and the damper mounting part 1*ad*.

Figure 7:
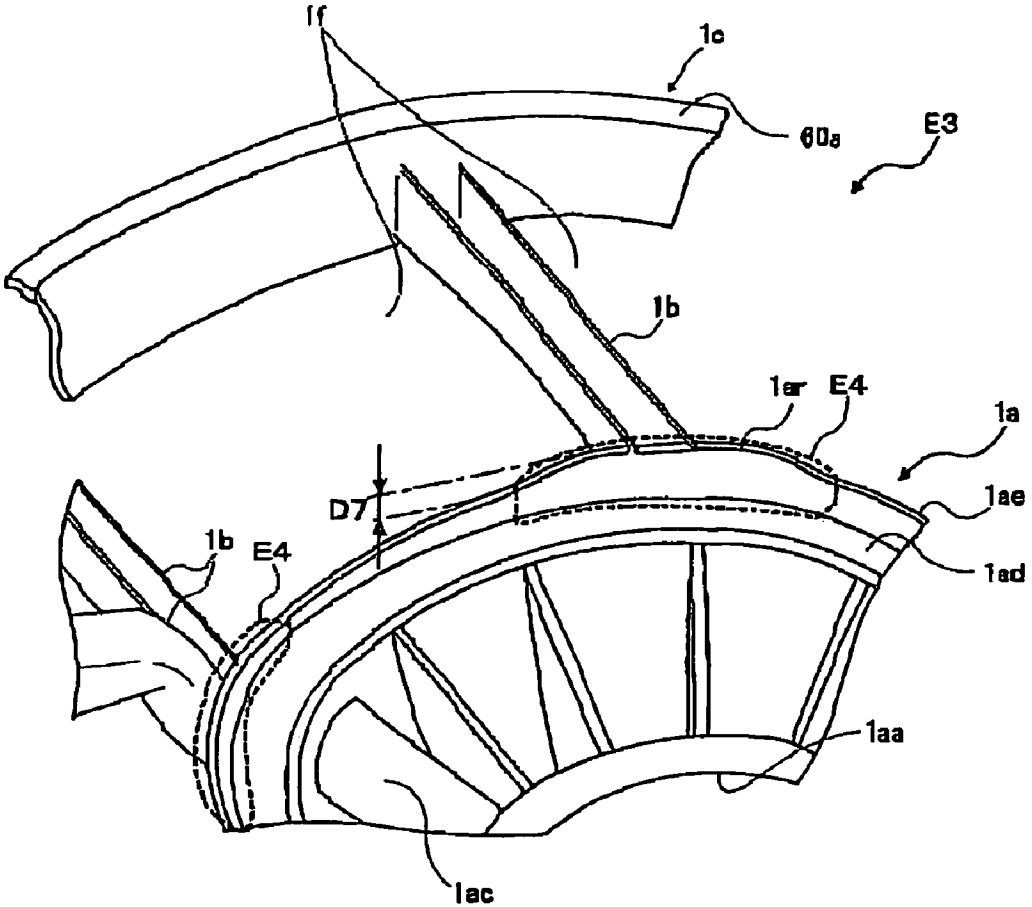
FIG. 7 shows an enlarged perspective view of a part of the frame corresponding to a broken-line area E3 shown in FIG. 6.

FIG. 7 enlarges and shows such a state that the above-mentioned respective components are organically connected.

FIG. 7 is an enlarged perspective view of a part corresponding to the vicinity of the broken-line area E3 when the frame 1 is observed from the front side in FIG. 6. In addition, the broken-line area E4 shown in FIG. 7 corresponds to the broken-line area E4 in the broken-line area E3 shown in FIG. 6. The broken-line area E4 is an area in the vicinity of the rib 1*ae* connected to one end of the arm part 1*b*. In FIG. 6, one end side of each of the plural arm parts 1*b* existing in the vicinity of the mounting part 1*ca* is connected to the outer peripheral wall of the magnetic circuit housing unit 1*a* positioned on the lower side of the outer peripheral wall of the rib 1*ae* (corresponding to a chain-line area E5), and it is not connected to the outer peripheral wall of the rib 1*ae* corresponding to the area E5.

Figure 8A:
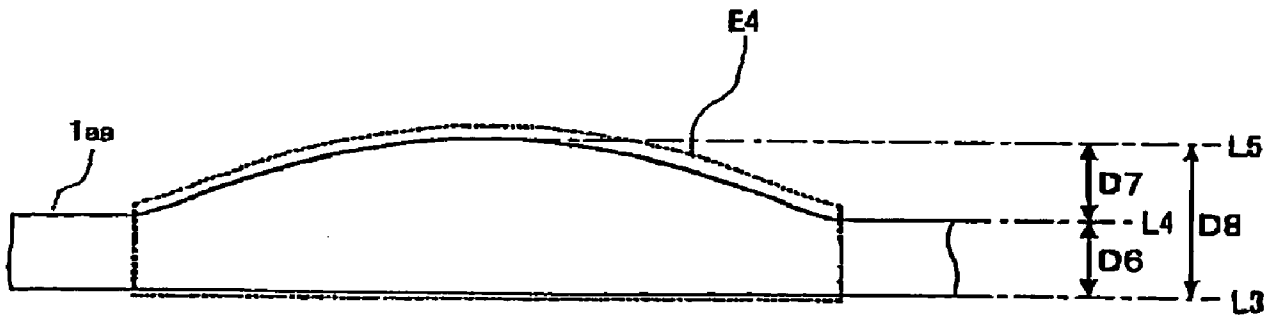
FIGS. 8A to 8C are enlarged side views of a rib corresponding to a broken-line area E4 shown in FIG. 6 and a rib according to a modification.

Particularly, in this embodiment, the height of the rib 1*ae* corresponding to the broken-line area E4 is set larger than the height of the rib 1*ae* corresponding to the area other than the broken-line area E4, as shown in FIG. 7. The height of the rib 1*ae* is partly different. Additionally, the rib 1*ae* corresponding to the broken-line area E4 is formed to have a mountain-shaped side shape. This point will be explained with reference to FIG. 8A. FIG. 8A is a side view enlarging and showing the rib 1*ae* corresponding to the vicinity of the broken-line area E4 shown in FIG. 6 and FIG. 7. FIG. 8A is also a side view of the vicinity of the correspondent rib 1*ae* when observed from the front side with respect to the central axis L1 of the frame 1.

In FIG. 8A, a straight line L3 becomes flush with the lower surface of the rib 1*ae*. The lower surface of the rib 1*ae* becomes flush with the upper surface of the damper mounting part 1*ad*. A straight line L4 becomes flush with the upper surface of the rib 1*ae* corresponding to the area other than the broken-line area E4. A straight line L5 becomes flush with the top surface of the rib 1*ae* corresponding to the broken-line area E4. The top surface of the rib 1*ae* is a surface where the height from the lower surface of the rib 1*ae* to the upper surface thereof becomes the largest.

The height of the rib 1*ae* corresponding to the area other than the broken-line area E4, i.e., the height from the lower surface of the rib 1*ae* to the upper surface of the rib 1*ae* corresponding to the area other than the broken-line area E4, becomes a distance from the straight line L3 to the straight line L4, i.e., a distance D6. Meanwhile, the height from the lower surface of the rib 1*ae* to the top surface of the rib 1*ae* corresponding to the broken-line area E4 becomes a distance from the straight line L3 to the straight line L5, i.e., a distance D8 (>D6). Namely, the top surface of the rib 1*ae* corresponding to the broken-line area E4 is positioned higher than the upper surface of the rib 1*ae* corresponding to the area other than the broken-line area E4 by a distance D7. In addition, the rib 1*ae* corresponding to the broken-line area E4 is formed to have the mountain shape when observed from the side.

Namely, the height of the rib 1*ae* in the vicinity of the area connected to each of the arm parts 1*b* is formed larger than the height of the rib 1*ae* corresponding to the area other than the vicinity, and the height of the rib 1*ae* is partly different. In a preferred example, the height of the rib 1*ae* corresponding to the broken-line area E4 is set to a height capable of withstanding the stress operating on the connecting part between the rib 1*ae* and the arm part 1*b* at the time of the driving of the speaker device 100, and a height (e.g., a height at least equal to or larger than the thickness of the damper 7) capable of regulating the position of the damper 7 when the damper 7 is mounted on the damper mounting part 1*ae*.

The embodiment of the present invention having the configuration has advantageous operation and effect, as compared with a comparative example which will be assumed below.

Now, a description will be briefly given of the configuration of the comparative example. In the comparative example, the height of the rib 1*ae* of the magnetic circuit housing unit 1*a* is set to the same height as the top surface of the rib 1*ae* of the embodiment in the entire circumferential direction. An illustration thereof is omitted here. In this point, the comparative example is different from this embodiment. The configuration other than the point of the comparative example is substantially same as that of the embodiment.

In the comparative example (similarly to the embodiment), at the time of the driving of the speaker device, the stress concentrates on the magnetic circuit housing unit 1*a* holding the speaker unit 50, particularly on the connecting part between the rib 1*ae* and the arm part 1*b*. In consideration of this point, in the comparative example, the height of the rib 1*ae* of the connecting part becomes high. That is, the area of the connecting part between the arm part 1*b* and the rib 1*ae* becomes large. Therefore, the connecting part sufficiently holds the strength capable of withstanding the stress.

However, at the time of the driving of the speaker device, so large stress does not operate on the rib 1*ae* corresponding to the part other than the connecting part between the rib 1*ae* and the arm part 1*b* (hereinafter also referred to as "rib 1*ae* corresponding to non-connecting part" for convenience). Thus, it is unnecessary to make the strength of the rib 1*ae* corresponding to the disconnecting part so large. Namely, the height of the rib 1*ae* corresponding to the non-connecting part may be smaller than the height of the connecting part between the rib 1*ae* and the arm part 1*b*. In this point, in the comparative example, since the height of the rib 1*ae* corresponding to the non-connecting part becomes same as the height of the connecting part between the rib 1*ae* and the arm part 1*b*, the material forming the unnecessary part of the rib 1*ae* is wasteful by the amount in the rib 1*ae* corresponding to the non-connecting part. In addition, by forming the unnecessary part of the rib 1*ae* corresponding to the non-connecting part, the frame problematically becomes heavy.

Meanwhile, in the embodiment of the present invention, the height of the connecting part between the rib 1*ae* and the arm part 1*b*, i.e., the height of the rib 1*ae* corresponding to the broken-line area E4, is set larger than the height of the rib 1*ae* corresponding to the area other than the broken-line area E4, and thus the height of the rib 1*ae* is partly different. Namely, in this embodiment, the height of the connecting part between the rib 1*ae* and the arm part 1*b* on which the stress mostly concentrates at the time of the driving of the speaker device 100 becomes large, and the height of the rib 1*ae* corresponding to the area other than the broken-line area E4 on which the stress does not operate so large becomes small. Additionally, by reflecting this, the rib 1*ae* corresponding to the broken-line area E4 is formed into the mountain shape when observed from the side. The height of the rib 1*ae* corresponding to the broken-line area E4 is set to the height capable of withstanding the stress operating on the connecting part between the rib 1*ae* and the arm part 1*b* at the time of the driving of the speaker device 100 and to the height capable of regulating the position of the damper 7 when the damper 7 is mounted on the damper mounting part 1*ae*.

Therefore, in the embodiment, the rib 1*ae* can be formed by the material less than that of the comparative example without decreasing the strength of the connecting part between the rib 1*ae* and the arm part 1*b*. Hence, the material forming the rib 1*ae* can be reduced. Accordingly, the frame 1 can be lightened.

Modification

Figure 8B:
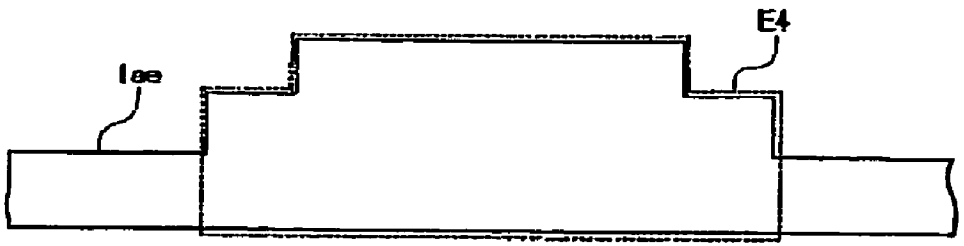
Figure 8C:
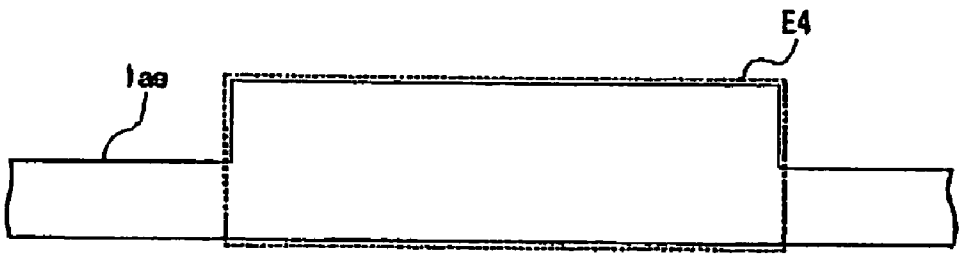

In the above embodiment, the rib 1*ae* corresponding to the broken-line area E4 is formed to have the mountain-shaped side shape. However, the present invention is not limited to this. Namely, in the present invention, the rib 1*ae* corresponding to the broken-line area E4 may be formed to have a step-shaped (shown in FIG. 8B) and a projection-shaped (shown in FIG. 8C) side shape without departing from the essence of the present invention.

What is claimed is:

1. A frame for a speaker device comprising:

a damper mounting part which has an annular shape and on which an outer peripheral portion of a damper is mounted;

an edge mounting part which is arranged on an outer side of the damper mounting part and on which an outer peripheral portion of an edge is mounted;

an arm part which connects the damper mounting part and the edge mounting part; and a rib which is provided to stand from an outer peripheral portion of the damper mounting part, wherein a height of the rib corresponding to a connecting part between the arm part and the rib is set larger than a height of the rib corresponding to a part other than the connecting part.

2. The frame for the speaker device according to claim 1, wherein the height of the rib corresponding to the connecting part is a height from an upper surface of the damper mounting part to an upper surface of the rib corresponding to the connecting part, and the height of the rib corresponding to the part other than the connecting part is a height from the upper surface of the damper mounting part to the upper surface of the rib corresponding to the part other than the connecting part.

3. The frame for the speaker device according to claim 1, wherein the height of the rib corresponding to the connecting part is formed at least equal to or larger than a thickness of the damper.

4. The frame for the speaker device according to claim 1, wherein the rib corresponding to the connecting part is formed into a mountain shape, a step shape or a projection shape when observed from a side thereof.

5. A speaker device comprising a frame including:

a damper mounting part which has an annular shape and on which an outer peripheral portion of a damper is mounted;

an edge mounting part which is arranged on an outer side of the damper mounting part and on which an outer peripheral portion of an edge is mounted;

an arm part which connects the damper mounting part and the edge mounting part; and a rib which is provided to stand from an outer peripheral portion of the damper mounting part, wherein a height of the rib corresponding to the connecting part between the arm part and the rib is set larger than a height of the rib corresponding to a part other than the connecting part.

* * * * *